United States Patent [19]

Ekblad

[11] 4,366,366

[45] Dec. 28, 1982

[54] ELECTRIC IRON STAND WITH TIME DELAY SAFETY SWITCH ARRANGEMENT

[76] Inventor: Carl A. Ekblad, 4023 Heath Rd., Jacksonville, Fla. 32211

[21] Appl. No.: 184,204

[22] Filed: Sep. 5, 1980

[51] Int. Cl.[3] ..... H05B 1/02; D06F 79/02

[52] U.S. Cl. ..... 219/247; 38/96; 38/142; 200/85 R; 219/242; 219/250; 219/259; 219/492; 219/518; 248/117.3; 307/119; 307/141.4; 307/141.8; 361/195; 361/202

[58] Field of Search ..... 219/245–259, 219/242, 518, 492, 493; 38/96, 142; 248/117.1–117.7; 307/119, 141, 141.4, 141.8; 200/85; 361/195, 202

[56] References Cited

U.S. PATENT DOCUMENTS

| | | | |
|---|---|---|---|
| 1,350,933 | 8/1920 | Oca-Balda | 219/257 X |
| 1,366,480 | 1/1921 | Oca-Balda | 219/257 X |
| 1,468,296 | 9/1923 | Hodgson | 219/259 |
| 1,496,699 | 6/1924 | Wooden | 219/246 X |
| 1,704,988 | 3/1929 | Mateen | 219/246 X |
| 2,525,334 | 10/1950 | Baker | 361/202 X |
| 2,740,923 | 4/1956 | Loeber | 361/202 X |
| 3,424,894 | 1/1969 | Schwartz et al. | 219/250 |
| 3,492,459 | 1/1970 | Schwartz | 219/251 |

FOREIGN PATENT DOCUMENTS

| | | | |
|---|---|---|---|
| 1029791 | 2/1955 | Fed. Rep. of Germany | 219/259 |

*Primary Examiner*—A. Bartis

[57] ABSTRACT

A stand for an electric iron incorporates an automatic time delay safety switch arrangement which reduces the chances of fires being started by an unattended iron and serves to save a substantial amount of electric energy by cutting off the current to the iron when it is left turned-on but unattended. The stand includes a hinged, spring biased platform of insulating material for supporting an electric iron during non-use periods. Placement of the iron on the platform causes the platform to pivot closing a normally open switch. Closure of the switch energizes a standard electrically energized time delay relay mounted on the platform. After lapse of a predetermined time period, the time delay relay actuates a manually resettable electric relay from a first condition allowing the electric iron to be energized from a power supply socket on the platform to a second latched condition whereby the iron is deenergized. Should the iron be removed from the platform before the lapse of the predetermined time period, the iron remains energized and the time delay automatically resets itself for the next placement of the iron on the platform. Actuation of the resettable relay to its second position also causes the time delay means to be automatically reset. However, a manual reset button on the resettable relay must be actuated to return the resettable relay to its first condition from the second condition to again energize the iron.

3 Claims, 4 Drawing Figures

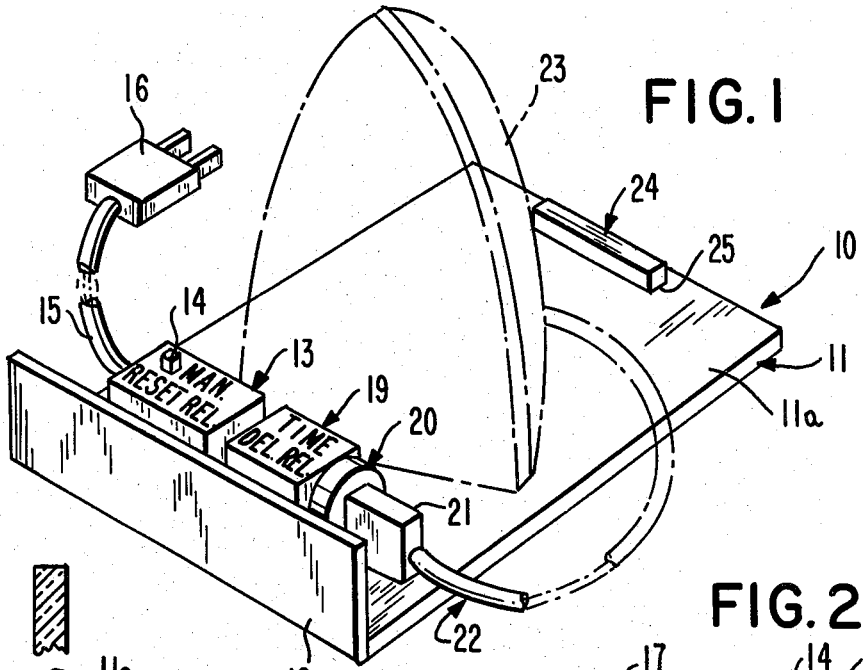
FIG. 1
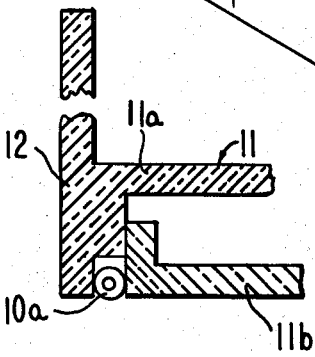
FIG. 4
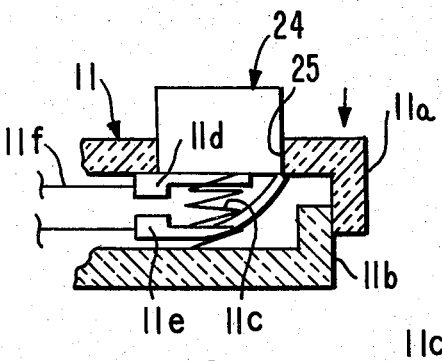
FIG. 3
FIG. 2
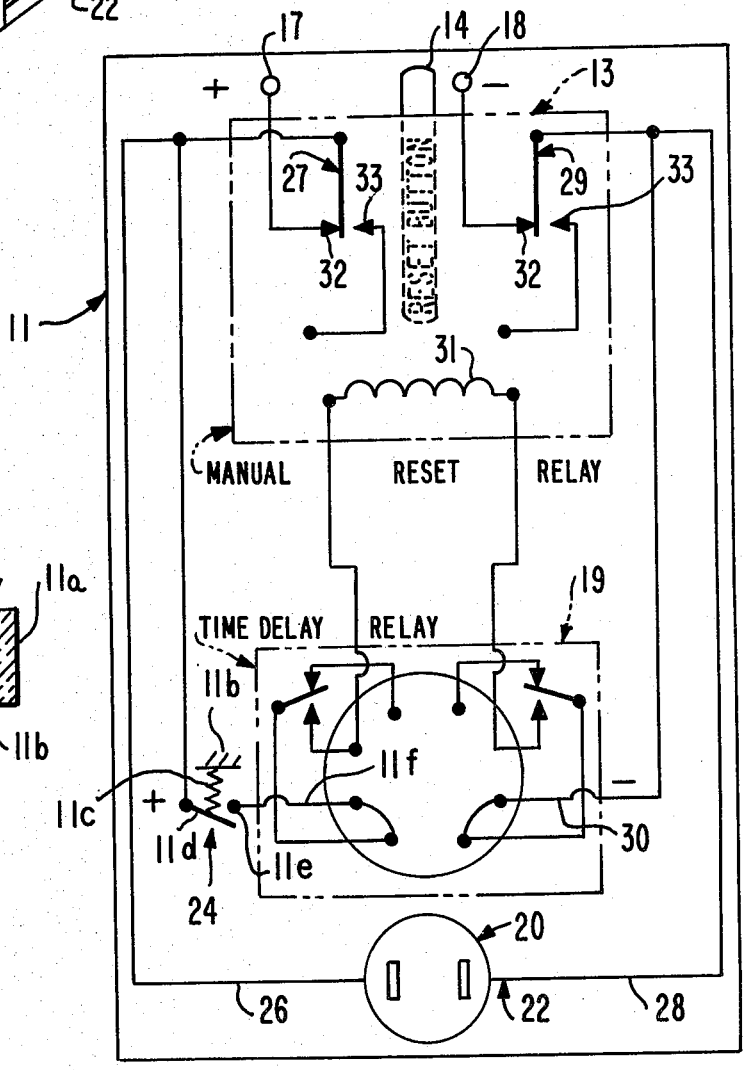

ELECTRIC IRON STAND WITH TIME DELAY SAFETY SWITCH ARRANGEMENT

The invention relates to control devices, and more particularly, to an automatic iron safety switch.

It is therefore, the principal object of this invention to provide an automatic iron safety switch which will serve as a means of reducing the changes of a fire occurring when an iron is not turned off after use and the users will not need to worry after leaving their residence about whether they turned off the iron.

Another object of this invention is to provide an automatic iron safety switch, which will enable the user to save a substantial amount of electric energy, by cutting off the current to the iron when it is not attended.

Another object of this invention is to provide an automatic iron safety switch, which will be adaptable for use with other electrical products which are subject to being left turned on inadvertently after use.

A further object of this invention is to provide an automatic iron safety switch, which, by modification, may be adaptable for installation within an iron when it is being manufactured.

Other objects of the present invention are to provide an automatic iron safety switch which is simple in design, inexpensive to manufacture, rugged in construction, easy to use and efficient in operation.

These and other objects will be readily evident upon a study of the following specification and the accompanying drawing wherein:

FIG. 1 is a perspective view of the present invention, showing an electric iron in phantom;

FIG. 2 is a schematic diagram of the electrical circuit of FIG. 1;

FIG. 3 is an enlarged transverse section taken through the spring-loaded switch which extends upwards from the top of the iron supporting platform shown in FIG. 1; and FIG. 4 is similar to FIG. 3, but illustrates the hinged end of the iron supporting platform.

According to this invention, device 10 is shown to include a hollow rectangular platform 11 made of a suitable insulating material. Platform 11 includes a top member 11*a* which freely receives the bottom 11*b* which is hinged by a hinge 10*a* at the right angle lip 12 of top member 11*a* for a purpose that hereinafter will be described.

A standard manually re-set relay 13 is fixedly secured in a suitable manner (not shown) to the lip 12 and the top member 11*a* of platform 11 and the re-set bottom 14 extends upwards therefrom. An electric cord 15, with its plug 16 for being received in a suitable electric outlet, is connected at its opposite end to the terminals 17 and 18 extending from re-set relay 13. A standard time-delay relay 19 is also fixedly secured in a suitable manner (not shown) to top member 11*a* and lip 12 and a plug receptacle 20 is secured fixedly in a manner (not shown) to top member 11*a* for removably receiving plug 21 of cord 22 which normally extends from electric iron 23. A normally open switch 24 is fixedly secured in a suitable manner within the opening 25 through top member 11*a*. A spring 11*c* is fixedly secured at one end to electrical contact 11*d* of switch 24 and the opposite end urges against the bottom member 11*b*. The contacts 11*d* and 11*e* are normally open and are secured in series with the positive polarity lead 11*f* of time-delay relay 19 and lead 11*f* is secured at its opposite end to wire 26, which is secured at one end to electrical outlet 20 at one side. The opposite end of wire 26 is secured to movable contact 27 of relay 13. A wire 28 is secured at one end to the other side of outlet 20 and the opposite end thereof is secured to movable contact 29 of relay 13. The negative polarity lead 30 of time-delay relay 19 is also secured to wire 28 at contact 29 of relay 13.

In use, when the re-set button 14 on relay 13 is depressed with device 10 connected to an A.C. current source by plug 16 means and the cord 22 of iron 23 plugged into outlet 20 current will flow into the iron however, when iron 23 is placed on the platform top member 11*a* current will also flow to time-delay 19 because the weight of iron 23 will urge the spring-loaded contact 11*d* of switch 24 down into engagement with contact 11*e*, thus closing the circuit to time-delay relay 19.

After a predetermined time period of approximately five minutes the time-delay relay 19 will activate the coil 31 in re-set relay 13, which will cause contacts 27 and 29 in relay 13 to shift from electrical conducting contacts 32 connected to terminals 17 and 18 to a non-conducting position in engagement with contacts 33. That are locked into this position by the re-set button 14 on relay 13. Thus all current ceases to flow to both the iron 23 and time delay relay 19.

When ironing is to be resumed, the re-set button 14 on relay 13 is depressed thereby releasing contacts 27 and 29 from their locked position in engagement with contact 33 and returning them to the electrical conducting contact with contacts 32. When the above-mentioned occurs, the timing cycle begins again and current flows to the iron 23 and to the relay 19 if the iron 23 remains on the platform 11.

If iron 23 is lifted from platform 11 before the predetermined time period has been achieved, relay 19 will automatically and instantly re-set itself; therefore, the timing cycle will begin anew each time iron 23 is placed upon platform 11 and the above-mentioned process will go on continuously.

It shall be noted that the iron 23 must be placed on platform 11 each and every time so as to enable device 10 to operate.

It shall also be recognized that the heretofore described components may be readily designed to fit within the structure of irons 23 currently being manufactured, which will eliminate the platform 11, and the springloaded switch 24 may be located on the rear end of iron 23. The re-set relay 13 can then be placed towards the front of iron 23 where the re-set button 14 is conveniently reached for re-setting and the relays 13 and 19 can be combined into one unit.

While various changes may be made in the detail construction, it is understood that such changes will be within the spirit and scope of the present invention, as is defined by the appended claims.

What I now claim is:

1. An automatic iron safety switch device and support stand, comprising, in combination, a platform of insulating material for supporting an electric iron, a normally open switch secured in said platform and arranged to be closed by the weight of an electric iron placed on said platform, a manually resettable relay secured to the surface of said platform, an outlet socket on the surface of said platform into which the cord of an iron can be plugged for energization, said manually resettable relay including a switch device having a first position connecting said outlet socket to a power supply source and a second position disconnecting the outlet socket from the power source, said manually resettable relay further including an operating coil arranged to move the switch device from the first position to the second position when the coil is energized, a manually resettable latch means for holding the switch device in the second position when moved thereto until manually reset and a manual reset button for returning the switch device to its first position, a standard time-delay relay mounted on the surface of said platform, said time-delay relay including an electrically operated timing means and a normally open switch means, said timing means arranged to automatically close said normally open switch means after the lapse of a predetermined time period, said electrically operated timing means being connected to said power source for energization through said platform switch and said switch device in said first position thereof, whereby the timing means will be operative only when an iron is positioned on said platform switch and the switch device of said manually resettable relay is in its first position, the normally open switch means of said time-delay relay being connected to the operating coil of said resettable relay and arranged to energize the operating coil when closed after the lapse of said predetermined time period by said timing means to move the switch device of said manually resettable relay to its second position, thereby deenergizing the outlet socket and timing means and latching the switch device in its second position, said time delay relay being so constructed that should the iron be removed from said platform before the lapse of said predetermined time period to open the platform switch, the timing means will be deenerzied and the time-delay relay reset, and movement of said switch device to its second position likewise deenergizing said timing means and resetting said time-delay relay.

2. The combination according to claim 1, wherein said platform includes a top member hinged at one end to one end of a bottom member, said normally open switch having a movable contact secured fixedly to the opposite end of said top member, and a spring fixedly secured to the underside of said top member urging against said bottom member of said platform on its interior to maintain the switch open in the absence of an iron being placed on said top member.

3. The combination according to claim 2, wherein said manually resettable relay and said outlet socket for the plug of the cord of said iron are fixedly secured to the top surface of said top member of said platform by suitable means.

* * * * *